United States Patent [19]

Meissner et al.

[11] 3,939,803

[45] Feb. 24, 1976

[54] HIGH TEMPERATURE BOILER AND METHOD

[75] Inventors: Herman P. Meissner, Winchester, Mass.; Frank C. Schora, Palatine, Ill.

[73] Assignee: Institute of Gas Technology, Chicago, Ill.

[22] Filed: Aug. 12, 1974

[21] Appl. No.: 496,763

Related U.S. Application Data

[63] Continuation-in-part of Ser. No. 414,202, Oct. 9, 1973.

[52] U.S. Cl. ..... 122/31 R; 122/28

[51] Int. Cl.[2] ..... F22B 1/06

[58] Field of Search ..... 122/27, 28, 31

[56] References Cited

UNITED STATES PATENTS

| | | | |
|---|---|---|---|
| 1,127,690 | 2/1915 | Smoot | 122/28 |
| 1,682,265 | 8/1928 | Bringhenti | 122/31 X |
| 1,807,783 | 6/1931 | Gay | 122/31 |
| 1,997,980 | 4/1935 | Smith | 122/31 X |
| 2,561,471 | 7/1951 | Hatfield | 122/31 |
| 3,032,482 | 5/1962 | Shoemaker | 122/31 X |
| 3,164,957 | 1/1965 | Fricke | 122/31 X |

*Primary Examiner*—Kenneth W. Sprague
*Attorney, Agent, or Firm*—Thomas W. Speckman

[57] ABSTRACT

A process for vaporizing liquid water which allows the use of relatively impure boiler feed water comprising providing a heat-carrying liquid at a predetermined elevated temperature to the boiler, providing liquid water to the boiler, transferring heat from the heat-carrying liquid directly to the liquid water to be vaporized within the boiler and separately withdrawing the produced steam from the boiler. Suitable heat-carrying liquids include lead, tin and bismuth and alloys principally thereof. A process for the production of superheated steam from natural waters which have not been previously purified utilizing the above described process for production of steam in combination with a process for superheating the steam by passing the produced steam in heat exchange relation with a plurality of liquid droplets of molten metal or a molten inorganic salt which has been heated to a predetermined temperature for superheating the steam.

12 Claims, 3 Drawing Figures

50
STEAM
40
55
54
WATER IN
53
V
PURGE
FOR
WATER
52
61
HEATER
63
PURIFIER
62
PUMP
HEAT CARRYING
LIQUID
51
HEAT
CARRYING
LIQUID
MAKE-UP

HIGH TEMPERATURE BOILER AND METHOD

CROSS REFERENCE TO RELATED APPLICATION

This application is a continuation-in-part of our pending application Ser. No. 414,202 filed Nov. 9, 1973.

The problems of boiler and heat exchanger deterioration coupled with high maintenance requirements and decreasing heat exchange efficiencies has long plagued industry where generation of steam is required. Natural waters used for steam generation invariably contain impurities such as suspended solids; dissolved gases; dissolved inorganic matter such as silicas, and the chlorides, carbonates, sulfates of sodium, calcium, magnesium, and the like; dissolved organic matter and frequently waste materials from industry. The use of impure water in conventional boilers lead to corrosion, particularly on the heat exchange surfaces such as the boiler tubes or the boiler vessel walls, formation of scale causing overheating of the heat transfer surfaces, priming causing bumping and droplet entrainment in the steam and foaming. These problems and the previous necessity for heat transfer through boiler tubes or the vessels themselves, have created severe limitations upon materials of construction of such boilers. The difficulties resulting from use of impure water are greatly increased with higher boiler temperature and pressure requirements desired by industry.

One method of reducing these difficulties involves recycling condensed steam as in most power plants. Such condensate is relatively free from impurities which were left behind in vaporization. However, losses of condensate always recur so that some make-up feed water is always required, involving need for purification.

In attempts to control the above difficulties encountered with impure water, boiler feed water has been purified by various methods such as chemical treatment with lime or soda, ion exchange purification, evaporation and the like. Such purification methods become increasingly costly and less efficient when water of lower quality is used. Even when recycled condensate is available for addition to boiler feed, as in steam-power plants, purification problems cannot be avoided. When the produced boiler steam is principally used for further processing so that there is little or no returnable condensate the problems created by continual utilization of impure feed water are correspondingly large. Even though purified water is utilized as boiler feed, the materials of construction of the boiler vessel and tubes is limited due to the necessity for heat exchange taking place through these structures.

It is an object of this invention to provide an improved process and structurally simplified apparatus for vapor generation, especially steam generation, which avoids the above disadvantages.

It is another object of this invention to provide a process and apparatus which allows use of relatively impure boiler feed water in a highly efficient steam generation process.

It is still another object of this invention to provide a process and apparatus for the production of steam from relatively impure water under conditions of high temperature and pressure.

A still further object of this invention is to provide a process and apparatus for production of superheated steam from natural waters which have not been previously purified.

Another object of this invention is to provide a process and apparatus for the total evaporation of natural waters which have not been previously purified.

A further object of this invention is to provide a process and apparatus which allows corrosion-resistant materials of construction having poor heat transfer characteristics to be utilized in boiler construction.

These and other objects, advantages and features of this invention will be apparent from the description together with the drawings wherein.

This invention provides direct thermal exchange between a liquid water phase to be heated and a heat-carrying liquid. The heat-carrying liquid should have a vapor pressure as low as possible and preferably negligible over the temperature range used. Thus, evaporation of the heat-carrying liquid is kept to a minimum and heat entering or leaving the heat-carrying liquid serves to change its temperature rather than to supply the heat for its vaporization. The heat-carrying liquid used in a boiler, according to this invention, is selected to be chemically non-reactive with components present in the liquid water system. This chemical non-reactivity may be a property of the heat-carrying liquid itself, or may be achieved by introduction of another chemical such as hydrogen to prevent oxidation of liquid metals. The heat-carrying liquid is selected to be one whose melting temperature lies below the minimum desired boiler operating temperature to maintain a safe margin between heat-carrying liquid solidification and the minimum boiler temperature.

The term "boiler" as used throughout this description and appended claims is used to mean the vessel in which thermal exchange takes place between the heat-carrying liquid and liquid water being vaporized and/or superheated and is not meant to be limited to specific designs of water boilers now in use.

Generally, this invention is carried out by introducing at least a part of the heat into a boiler by injection of a heat-carrying liquid into the boiler, transferring heat by direct contact between the heat-carrying liquid and the liquid water to be vaporized and/or superheated within the boiler; draining the heat-carrying liquid from the boiler and externally reheating, pressurizing and purifying, if necessary, the heat-carrying liquid for reinjection to the boiler. Thus, a major part or all of the heat may be inntroduced into the boiler in the heat-carrying liquid thereby avoiding the necessity for conduction of heat through the boiler and/or tube walls. The heat-carrying liquid cycles continuously between the boiler and reheater and thus with a constant rate of addition to the liquid water to be heated, steady state conditions may be approached. The flow rates of the heat-carrying liquid and water are adjusted to obtain desired thermal balance. The maximization of heat transfer rates between the heat-carrying liquid and the liquid water within the boiler is, of course, desired and may be achieved in a variety of specific apparatuses which will be come obvious upon further reading of this disclosure.

Figure 1:
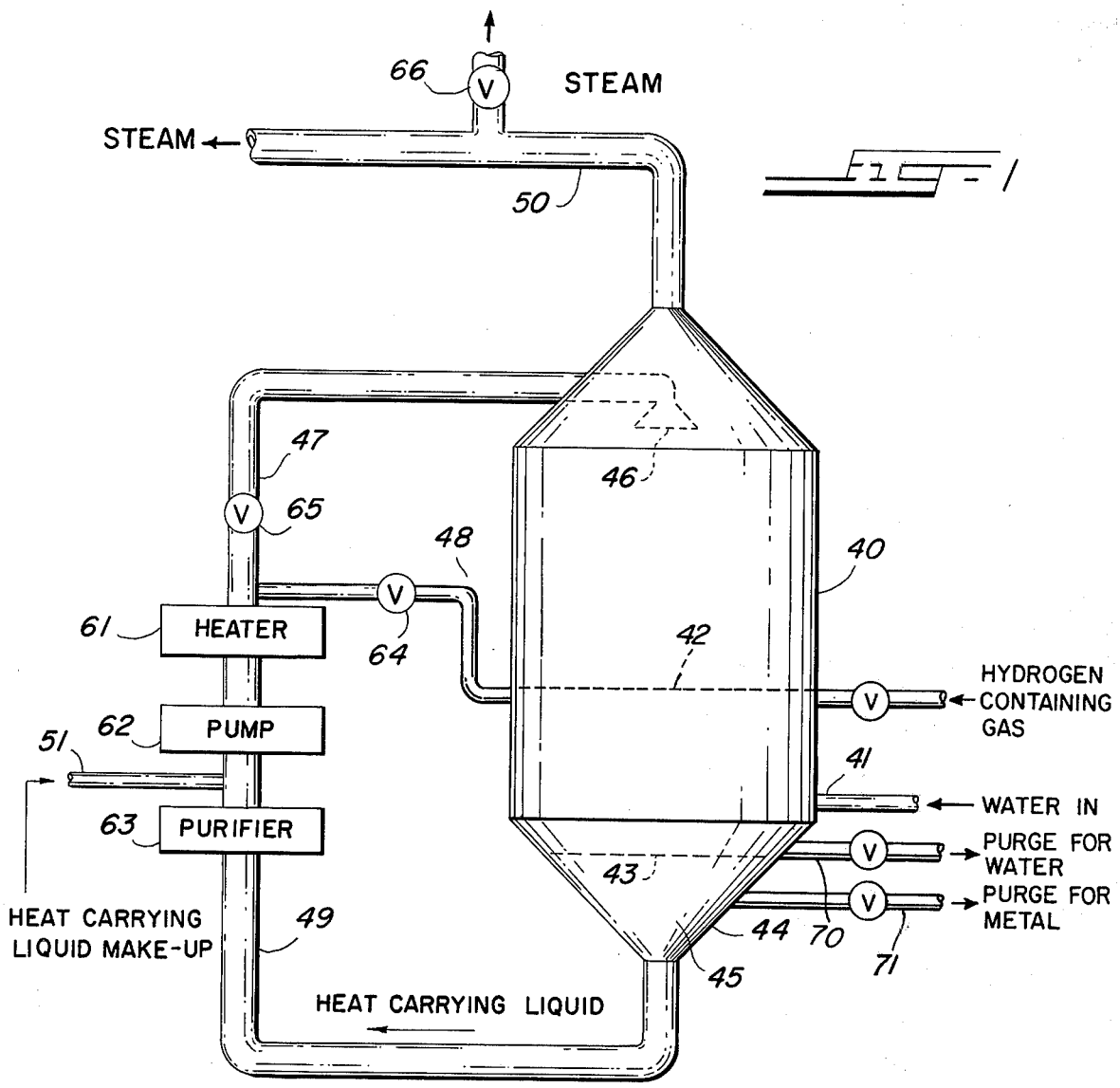
FIG. 1 is a perspective view of an apparatus with parts broken away to show interior detail of a boiler of this invention.

FIG. 1 shows one preferred embodiment of this invention. The boiler generally referred to as 40 is a vertical cylindrical vessel having sides 52, a conical top 51 and a conical bottom 44. The liquid water to be heated within the boiler is introduced at the bottom portion of the cylindrical side walls through inlet tube 41. In the embodiment shown in FIG. 1, the level of the water in boiler 40 is maintained such that the upper boundary is maintained at level 42 and the lower boundary is maintained at level 43.

A suitable heat-carrying liquid may be introduced at the upper portion of boiler 40 through spary 46. The distance of spray 46 from upper boundary 42 of the process liquid is not critical, but should be sufficient to provide for dispersion of droplets of heat-carrying liquid across the entire cross-sectional area of the boiler before reaching upper boundary 42 of the liquid water. It may be desired to superheat the vapor of the liquid water passing through the headspace and to achieve this, the distance of spray 46 to the liquid water may be increased and the temperature of the heat-carrying liquid may be increased to obtain some superheating in the headspace.

The heat-carrying liquid passes in droplet form through the liquid water from the upper boundary maintained at level 42 to the lower boundary maintained at level 43 in direct heat exchange relation with the liquid water. Thus, the heat-carrying liquid directly transfers thermal energy to the water to form steam which passes through the upper boundary 42 and upward through the boiler headspace countercurrent to the droplets of heat-carrying liquid from spray 46. The heat exchange and vaporization takes place at the surface of the heat-carrying liquid droplets and the soluble impurities will tend to remain in the water phase and can be purged by bleeding a small side stream 70. Some impurities will be captured by the heat-carrying liquid, which is removed from the boiler to heat-carrying liquid heater 61, pump 62, and if necessary, purifier 63.

The embodiment shown in FIG. 1 is one in which the major portion of heat-carrying liquid is recycled through spray 46. When the heat carrying liquid is recycled both through spray 46 and a major portion is returned to the pool of heat-carrying liquid at the bottom of the boiler, a much thinner layer of water is present in the boiler than shown in FIG. 1.

Heating the heat-carrying liquid can be achieved by heater means 61 of any suitable type, several of which will be apparent. For example, the heat-carrying liquid can travel through heater tubes in a conventional furnace or alternatively, submerged combustion can be carried out with the flame directly in the heat-carrying liquid under conditions such that no undesirable reactions take place involving the heat-carrying liquid, such as oxide formation with molten metal, is used. The heater means may utilize any readily available fuel such as electricity, fossil fuels or thermal energy available as a result of plant operation or a nuclear reactor. The only requirements of the heat is that it heat the heat-carrying liquid to sufficiently high temperature as will be discussed later herein annd that it not provide a situation wherein reaction with the heat-carrying liquid takes place.

Pump means 62 may be any suitable liquid pumping means which is adequate to recirculate the heat-carrying liquid through the boiler in desired volumes. Suitable pumping means such as electric impeller pumps, are readily known in the art.

When the feed water contains contaminants which are removed by the heat-carrying liquid, it is necessary to provide purifier means 63 for the recycled heat-carrying liquid to prevent undesired buildup of the contaminants. The impurities in the heat-carrying liquid may generally be readily removed from the heat-carrying liquid by filtration, by skimming of the solids from the top of the liquid phase, or similar methods. When operating with a layer of liquid water on top of the molten metal in the boiler, then those inpurities which collect in the water layer rather than in the molten metal can be removed by purging of the water layer.

While loss of the heat-carrying liquid with the steam produced or by solution is not very great, a heat-carrying liquid makeup source should be provided in the recycle loop before the pump and heater means as shown in FIG. 1 as 51.

The produced steam rises and due to the conical shape of the top of boiler 40, readily flows from the boiler in conduit 50.

When the liquid phase of water is present, as in the process just described, the transition from liquid to vapor takes place at the pressure and temperature indicated by the vapor pressure curve for water. Thus, saturated steam may be produced by this embodiment and superheating within the boiler is somewhat limited. The steam removed by conduit 50 may be passed to a conventional superheater in cases where it is sufficiently clean. In cases where the steam contains impurities it is preferred to utilize the high temperature thermal exchanger shown in FIG. 2 and further described below for superheating.

The process of this invention may be operated substantially without a liquid phase of the water. Under conditions of lower pressure the feed water can be introduced below the surface of the heat-carrying liquid. As a result of the sudden complete vaporiization of the water, droplets of heat-carrying liquid mat rise and fall in the upper (headspace) zone of the boiler. In those cases where the resultant agitations is too violent, the feed water can be sprayed directly onto the surface of the hot molten metal. The heat-carrying liquid may fill the boiler to upper boundary location shown as 42 in FIG. 1 and while spray 46 may still be advantageously utilized, the recycle of the heat-carrying liquid from the recycle loop may be returned directly to the body of the heat-carrying liquid within the boiler as shown by conduit 48. The flow of the heat-carrying liquid can be controlled as desired between spray 46 and return to the liquid pool by conduit 48 by proper adjustment of valves 64 and 65. The vapor generated will be superheated by suitable adjustment of the temperature of the heat-carrying liquid relative to the boiler pressure.

Figure 2:
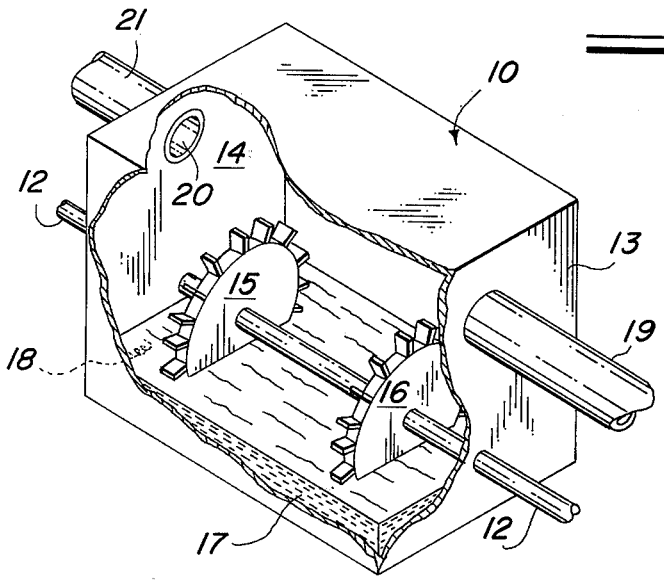
FIG. 2 is a perspective cutaway view of a gaseous high-temperature thermal exchanger for the production of superheated steam from steam produced in the boiler of FIG. 1.

An alternative way of superheating produced steam is shown in FIG. 2 wherein the steam produced in the boiler of FIG. 1 is carried directly into a high temperature thermal exchanger providing efficient transfer of thermal energy between molten liquid and a gas stream. A suitable apparatus and process is more fully described in our pending application, Ser. No. 414,202, filed Nov. 9, 1973.

Referring to FIG. 2, enclosed chamber 10 is provided with through shaft 12 suitably journaled in opposing walls 13 and 14. Paddle wheels 15 and 16 are fixedly mounted on shaft 12 and rotate therewith. Pool 17 comprising a molten or liquid substance (primary liquid) is present at the bottom of enclosure 10 to a level such that the lower portions of paddle wheels 15 and 16 are immersed therein. Pool 17 may be maintained at the desired temperature by heat exchange through the chamber walls or by a heat exchange surface within the pool as shown by coil 18. Hot gas to be heated is supplied to chamber 10 via conduit 19, and exits from chamber 10 via exit port 20 and conduit 21.

In operation, pool 17 is maintained at a desired, predetermined temperature by heater means 18 and shaft 12 is driven so as to rotate paddle wheels 15 and 16, thus generating a spray of liquid droplets in the confined gas flow passageway defined by chamber 10. The resulting large surface area of the droplets provides a very rapid and effective heat transfer with a gas stream which is passed through chamber 10. Chamber 10 is filled with droplets of the primary liquid flung upward by rapidly rotating wheels, which are partly submerged in pool 17 of liquid filling the bottom part of the vessel. The droplets fly up through the gas, and then fall back again through the gas to pool 17 below, exchanging heat with the gas in the process. Some of the droplets strike the top of chamber 10 and drip off, falling back through the gas. The primary liquid in the pool of this exchanger can in turn be heated with a second circulating liquid traveling through coils 18 submerged in liquid pool 17 and maintained at the disired temperature. This second liquid can be molten salt or molten metal with heat transfer as sensible heat in this liquid. Alternatively, the primary heat-carrying liquid itself can be withdrawn and circulated through external cooling coils. Methods of adding heat to the primary liquid are readily apparent. A high heat flux between the gas and primary heat transfer liquid can be attained because of high concentration of liquid droplets which can be maintained by several methods in spray chamber 10.

The primary heat-carrying liquid selected can be a molten metal or a molten salt, depending upon desired properties. When the gases involved carry entrained liquids or solids, then a portion of such liquids or solids will be picked up in the primary heat transfer liquid. Removal of such material, when insoluble in the heat transfer liquid, can be accomplished by filtration, by skimming of the solids from the top of the liquid phase, or similar methods. Likewise, the process more fully described in our co-pending application, Ser. No. 414,202, filed Nov. 9, 1973, provides for removal of undesired solid, liquid or gaseous components of the steam effluent from the boiler operated in accordance with this invention.

Figure 3:
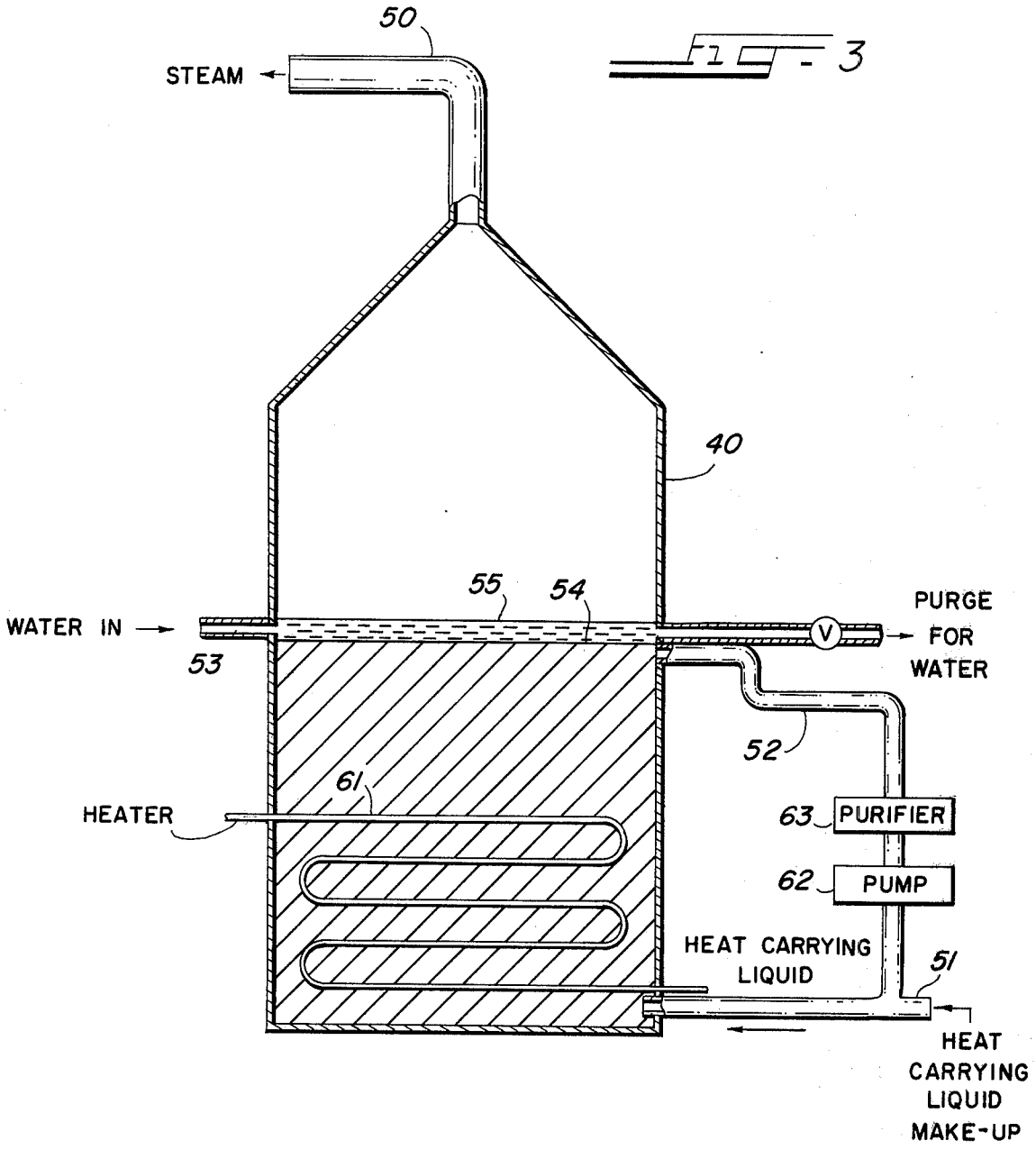
FIG. 3 is a cross-sectional view of another boiler of this invention.

FIG. 3 illustrates another embodiment of this invention wherein water is supplied to boiler 40 by conduit 53 at the upper surface 54 of heat-carrying liquid within the boiler. The layer of water is maintained relatively thin having upper surface shown as 55. The heat-carrying liquid is heated internally to the desired temperature by heater means 61 as described above. The water is vaporized by direct thermal transfer from the heat-carrying liquid to the water under conditions forming saturated steam. The steam leaves the boiler by conduit 50. Impurities in the supply water are deposited on the upper surface 54 of the heat-carrying liquid. The upper surface of the heat-carrying liquid may be continuously removed for purification and recycled as previously described in further detail and shown in FIG. 3.

Selection of a suitable heat-carrying liquid depends upon the chemical reactivity of impurities in the water and the operating temperature range contemplated in the boiler operation. Suitable materials for use as heat-carrying liquid for water vaporization are primarily metals which remain liquid and have low vapor pressures and low viscosities over the temperatures of interest. Further, it is desired that the heat-carrying liquid not chemically react with the water, consequently, sodium metal could not be used. Further, selection of a suitable heat-carrying liquid depends upon the melting temperature of the heat-carrying liquid relative to the lowest temperature of the boiler operation contemplated.

It is generally important to have the gases leaving the boiler as uncontaminated with vapor of the heat-carrying liquid as possible. Contaminates in the off-gas are undesirable for several reasons such as loss of the heat-carrying liquid, toxicity of the off-gas, and complications in later processing. Thus, mercury or sodium metal respectively boiling under atmospheric pressure at 648°F. and 660°F. would be unacceptable for an atmospheric operation, mercury because of its high vapor pressure and sodium because of its reactivity with water. Magnesium would be a relatively poor liquid for use at 932°F., for at this temperature, its vapor pressure is relatively high, (namely about 0.1 mm of mercury) and it reacts with water. Lead, with a vapor pressure at 930°F. of about $10^{-5}$ mm of Hg, would be much better for use at this temperature. The same reasons apply to the selection of other liquid materials.

Preferred metals for use as heat-carrying liquids include lead, melting at 620°F., tin, melting at 450°F., and bismuth, melting at 520°F. Alloys can advantageously be used at heat-carrying liquids when they have substantially lower solidifying temperatures than the constituent metals. For example, a lead-tin alloy containing 6.19 percent tin melts at 361°F. versus melting points of 620°F. for lead and 450°F. for tin. Common alloys principally of lead, tin and bismuth, may be used.

Tin and lead are especially preferred metals for use as heat-carrying liquids according to our invention. However, like most metals, they tend to oxidize when water is used. Such oxidation may be eliminated by maintaining a suitable concentration of hydrogen or other reducing gas in the boiler chamber. Table I shows the ratio (percent of volume) of hydrogen to water to avoid metal oxidation.

TABLE I

Minimum Ratio of Partial Pressures ($H_2/H_2O$) in the Vapor Phase to Avoid Metal Oxidation

| Temperature °F | Tin | Lead |
|---|---|---|
| 620 | 12 | 1 / 55000 |
| 980 | 1 | 1 / 15000 |
| 1340 | 0.3 | 1 / 6000 |

It is seen from Table I that lead is much more easily protected against oxidation by water than tin, requiring a much smaller concentration of hydrogen. In many instances, steam generated in the boiler system is utilized by being mixed with a reducing gas. Often in such occasions the reducing gas itself can be added to the boiler to provide the necessary protection against oxidation. Hydrogen is a preferred reducing gas and may be introduced below the surface of the heat-carrying liquid to obtain vigorous agitation.

The temperature and pressure for the process of this invention will be governed by the vapor pressure curve of water and whether or not there is a pool of water within the boiler. Thus, the pressures from atmospheric to about 4000 psia are suitable for conduct of the process of this invention. The upper number of 4000 psia is not critical nor limited by the process, but is merely set forth in view of present day materials and technology. The selection of suitable temperature and pressure relationships are readily apparent to one skilled in the art.

Apparatus for use in the process of this invention may be construced of conventional materials, but as differentiated from present boilers may be a containment vessel constructed of steel and effectively lined with a thermal insulating material or corrosion protecting coating such as ceramics. This has not been possible in existing boilers due to the necessity for thermal exchange through the vessel walls or other heat exchange surfaces.

The following Examples shown specific preferred embodiments of this invention.

EXAMPLE I

A boiler as shown in FIG. 1 is used to produce a gaseous mixture of hydrogen and water vapor at 650°F. and 2500 psia. In this gas mixture, the hydrogen partial pressure is 300 psia, and the water vapor partial pressure is 2200 psia, the latter corresponding to the saturation vapor pressure for water at this for water at this temperature. The partial pressure ration of hydrogen to water, namely 300/2200, is far above the value needed to protect the molten lead from oxidation by water at that temperature.

In operation, molten lead at 1200°F., liquid water at 100°F. and hydrogen gas at 100°F., are all pumped continuously and separately into the boiler. In passing through the boiler, the molten lead exchanges heat with the water and leaves at a temperature of 650°F. for reheating and recycle. A liquid water layer floating on the molten lead in the boiler is formed with both layers substantially at 650°F. The feed water to the boiler enters this floating layer, vaporizes, and leaves as steam. Hydrogen is introduced below the surface of the molten lead layer to secure more vigorous agitation in the system. Hot liquid lead is fed in part directly below the top of the molten lead layer and in part into the water layer to improve mixing.

The supply of feed water is regulated by a liquid level controller within the boiler, which maintains six inches of liquid water lying as a layer on top of the molten lead. Hot molten lead is recycled through the boiler — recycle system at a rate adequate to maintain the temperature of the lead poor constant at 650°F. The presence of the water layer assures the maintenance of the water vapor pressure at 2200 psia. The hydrogen containing gas is introduced at a rate so proportioned to the feed water rate that the total pressure remains at 2500 psia in the boiler system. Under these conditions, the product gas is saturated with water vapor at 460°F. and a total pressure of 2500 psia.

EXAMPLE II

The hydrogen-water vapor mixture produced according to Example I, at 2500 psia and 460°F. is superheated to 900°F. by passing through the superheater of FIG. 2. The lead pool in the bottom of this superheater is maintained at 1000°F. by withdrawing lead continuously from this pool, reheating it to 1200°F. and recycling it at the appropriate rate. The droplets of lead in the gas space of the superheater serve to heat the gases from 460°F. to 900°F.

EXAMPLE III

The process is conducted as in Examples I and II, except that the reducing gas injected is hydrogen diluted with $N_2$, CO and $CO_2$. Thus, the gas composition is 65 percent $H_2$, 10 percent $N_2$, 20 percent CO, five percent $CO_2$. This gas composition is still reducing to lead in the boiler and provides good protection against oxidation of the lead.

EXAMPLE IV

The boiler of FIG. 1 is operated to produce a superheated product gas stream at 850°F., but at a total pressure of 100 psia. Liquid water at 100°F., hydrogen gas at 100°F., and two streams of recycled lead at 1200°F., are pumped into the boiler. One stream of liquid lead enters directly into the pool in the bottom of the boiler, the other enters through a spray high in the vapor space, falling down through the rising gas and heating this gas to 850°F. by direct thermal transfer. Flow rates of feed water, hydrogen and the two lead streams are so balanced that the lead pool in the bottom of the boiler remains at 650°F. Water fed to the surface of this pool heats to its boiling temperature at 100 psia of 327.8°F. At this temperature, the water vaproizes immediately, mixes with the injected hydrogen and then heats to 850°F. as the gas mixture passes countercurrent through the boiler headspace past the falling lead droplets. Under these conditions of operation, no liquid water layer of any finite magnitude can form within the boiler.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for vaporizing liquid water comprising the steps:

providing a heat-carrying liquid having a low vapor pressure over the temperature range used selected from the group consisting of lead, tin and bismuth and alloys consisting principally thereof at a predetermined elevated temperature to a boiler;

providing liquid water to said boiler; transferring heat from the heat-carrying liquid directly to the liquid water to be vaporized within the boilers; and separately withdrawing the produced steam from the boiler.

2. The process of claim 1 wherein said heat-carrying liquid is lead and alloys thereof.

3. The process of claim 1 wherein said heat-carrying liquid is tin and alloys thereof.

4. The process of claim 1 wherein said heat-carrying liquid is introduced to said boiler by a spray located in the upper portion of said boiler, droplets of said heat-carrying liquid falling through the headspace of said boiler into a pool of said liquid water, and passing through said liquid water to a pool of heat-carrying liquid at the bottom of said boiler.

5. The process of claim 4 wherein said heat-carrying liquid is withdrawn from the bottom of said boiler and recycled to said spray through purifier means, pump means and heater means.

6. The process of claim 5 wherein the temperature of said heat-carrying liquid is elevated to superheat steam by countercurrent flow with said droplets of heat-carrying liquid in said headspace.

7. The process of claim 1 wherein said heat-carrying liquid is introduced to said boiler both through a spray in the upper portion of said boiler and directly to the pool of heat-carrying liquid at the bottom of the boiler.

8. The process of claim 1 wherein said boiler is operated substantially without a liquid phase of water being present by introducing water below the surface of said heat-carrying liquid obtaining sudden complete vaporization of said liquid water.

9. The process of claim 1 wherein said liquid water is natural water which has not been previously purified.

10. A process for vaporizing liquid water comprising the steps:

providing a heat-carrying liquid at a predetermined elevated temperature to a boiler;

providing liquid water to said boiler;

providing a reducing gas to said boiler to prevent oxidation of the heat-carrying liquid;

transferring heat from the heat-carrying liquid directly to the liquid water to be vaporized within the boiler; and separately withdrawing the produced steam from the boiler.

11. The process of claim 10 wherein said reducing gas is hydrogen.

12. A process for producing superheated steam from unpurified natural waters comprising in combination the steps:

providing a heat-carrying liquid at a predetermined elevated temperature to a boiler;

providing natural liquid water to said boiler;

transferring heat from the heat-carrying liquid directly to the natural liquid water to be vaporized within the boiler;

separately withdrawing the produced steam from the boiler;

passing said produced steam to a confined flow passageway;

providing a plurality of liquid droplets of a liquid selected from the group consisting of a molten metal and a molten inorganic salt in said passageway;

passing the steam through said passageway and in a heat exchange relationship with said droplets;

recovering the liquid droplets after heat exchange with said steam; and adjusting the recovered liquid to a predetermined temperature for superheated steam, said liquid providing recycle for production of said droplets.

* * * * *